United States Patent [19]

Holden et al.

[11] 4,007,668

[45] Feb. 15, 1977

[54] CRIMPER ASSEMBLY

[75] Inventors: Herbert K. Holden, Bon Air; Peter W. Mansfield, Richmond, both of Va.

[73] Assignee: American Filtrona Corporation, Richmond, Va.

[22] Filed: Mar. 28, 1975

[21] Appl. No.: 562,911

[52] U.S. Cl. ..... 93/1 C; 425/396

[51] Int. Cl.[2] ..... B31F 1/10

[58] Field of Search ..... 93/1 C, 77 FT; 184/14, 184/105 B; 425/366, 367, 369, 396

[56] References Cited

UNITED STATES PATENTS

| | | | |
|---|---|---|---|
| 2,582,067 | 1/1952 | Reeves | 184/105 B |
| 3,599,646 | 8/1971 | Berger et al. | 93/1 C UX |
| 3,637,447 | 1/1972 | Berger et al. | 93/1 C X |
| 3,735,672 | 5/1973 | Molins et al. | 93/1 C |

*Primary Examiner*—James F. Coan

*Attorney, Agent, or Firm*—Holman & Stern

[57] ABSTRACT

An improved crimper assembly for use in making crimped filter materials is disclosed. The improved features of the assembly include an insulated central heater block which incorporates a steam entrance housing. Also provided are side plate bearing blocks which are insulated from the heater block. Other features include means for precision alignment and interchangeability of components.

11 Claims, 6 Drawing Figures

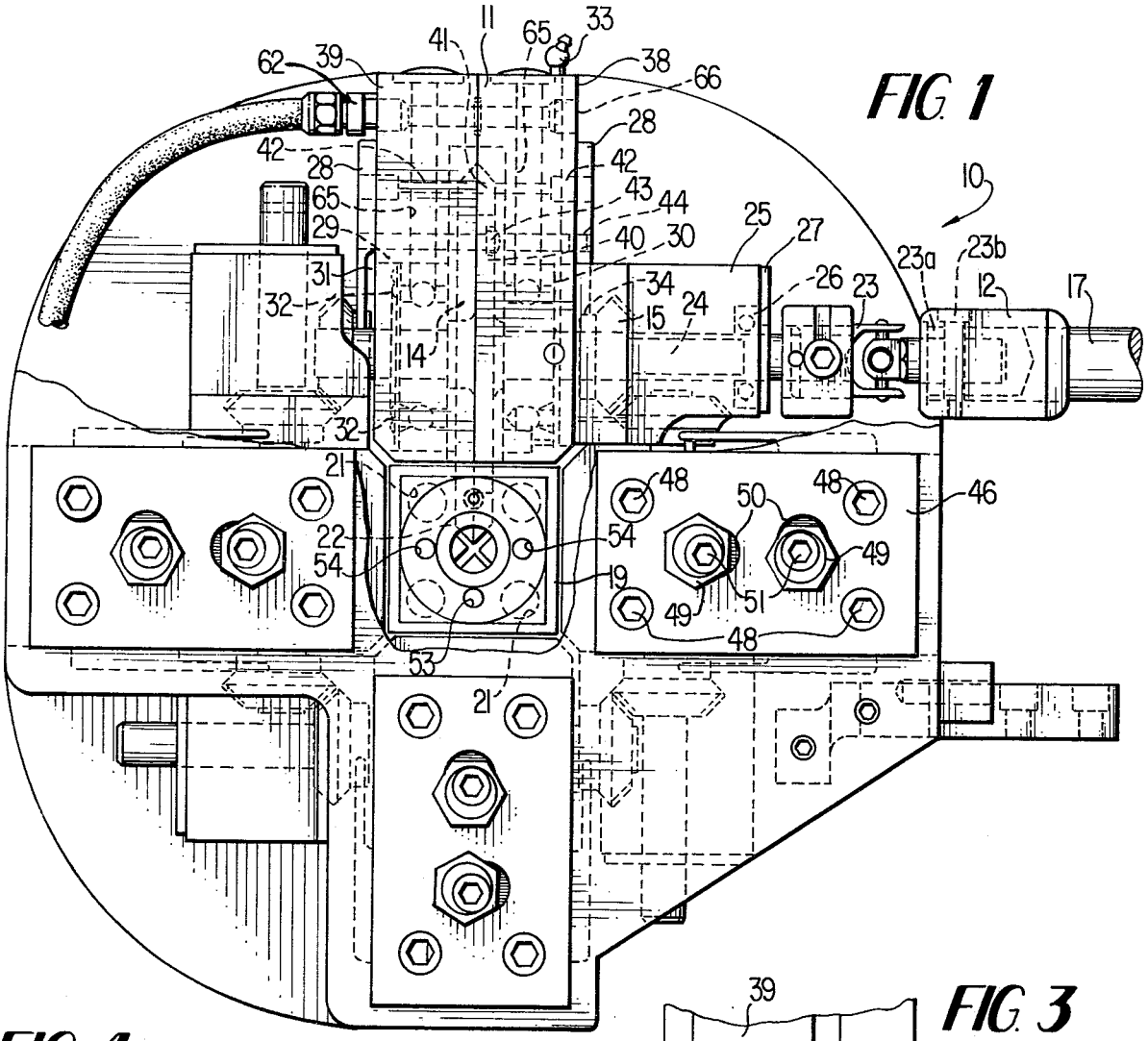
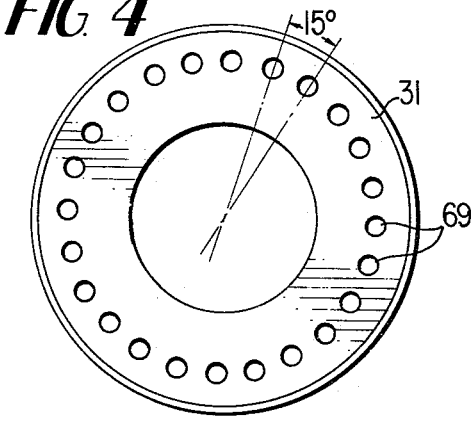
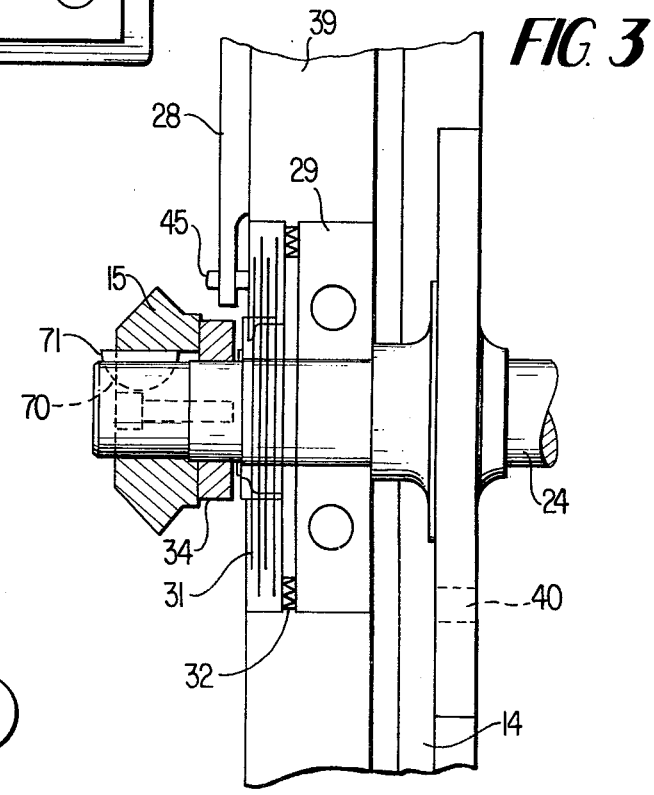
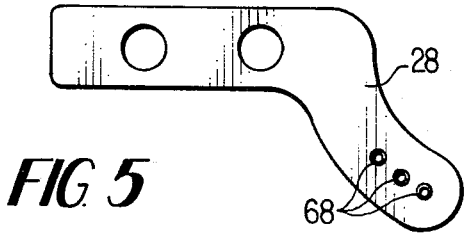
FIG. 5

CRIMPER ASSEMBLY

BACKGROUND AND SUMMARY OF THE INVENTION

The present invention relates to an improved crimper assembly for use in making filter materials. More particularly, the present invention relates to an improved crimper assembly having features which provide excellent results in imparting a crimped configuration to a formed rod of filter material such as tobacco smoke filter elements.

Previous apparatus for crimping filter materials for use in the manufacture of cigarettes and the like have included, for example, a crimping assembly such as that described in U.S. Pat. No. 3,826,177, such an assembly including an arrangement of crimping wheels for imparting to the filter material a particular configuration.

By the present invention, there is provided an improved crimper assembly which has been found to allow operation at higher production speeds and to provide significantly longer life between refurbishment of such crimper apparatus. The crimper assembly of the present invention includes a separate insulated central heater block which incorporates the steam entrance housing of the crimper, and a means for accurately aligning this housing. Also provided in the improved crimper assembly of the present invention are separate side plate bearing blocks which are insulated from the heater block. The crimper assembly further includes provision for an alignment slot in the crimping wheels, thus allowing for precision alignment of the wheels during initial set-up, as well as during future refurbishment of the crimper assembly. Incorporated in the crimper assembly are eight bevel gears which provide positive interlock in a 360° circle.

Additional features of the present invention include a drive shaft with universal joint incorporating a shear pin which provides positive torque breakaway if the crimper should become locked due to the failure of the gears or obstruction of the wheels and a coupling shoulder bolt in combination with a slotted shaft providing compensation for lateral misalignment and quick change of crimper assembly on the machine bed. Eccentric nuts facilitate the adjusting of the assembled individual crimper blocks in two planes. This feature provides an accurate and easy means of achieving crimper wheel alignment of each of the four crimping wheels relative to the other wheels. The end plates of the present crimper assembly have been designed to provide a center hole on one end with pin dowel alignment on the other end, which will allow precision alignment of the heater block within the assembly.

BRIEF DESCRIPTION OF THE DRAWINGS

The advantages and features of the improved crimper assembly of the present invention will be more fully understood from the following detailed description of the preferred embodiments, taken in conjunction with the accompanying drawings, wherein:

FIG. 1 is a partially broken-away vertical elevational view of the improved crimper assembly of the present invention;

FIG. 3 is an enlarged view of a portion of the view shown in FIG. 1;

FIG. 4 is a plan view of a bearing retainer plate employed in the present invention;

FIG. 5 is a plan view of a tension lock of the present invention; and

DESCRIPTION OF THE PREFERRED EMBODIMENTS

Figure 2:
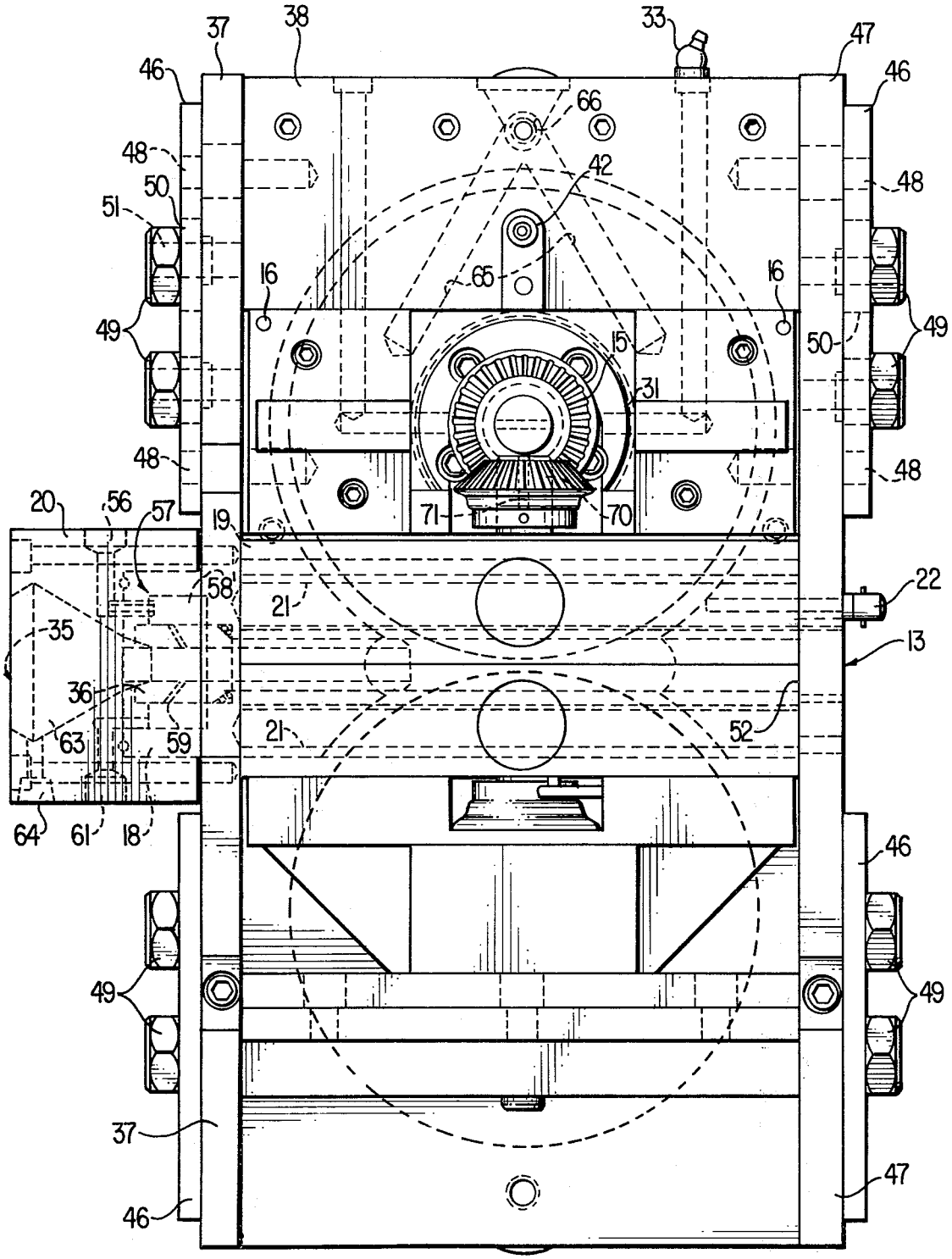
FIG. 2 is a side view of the crimper assembly shown in FIG. 1.

In the illustrated embodiment of the present invention as shown in FIGS. 1 through 6, apparatus is provided for imparting a crimped configuration to a formed rod of filtering material. In FIG. 1, the crimping assembly 10 is shown in detail in an elevational view, looking at the device from the front, or inlet end. The housing 11 is partially broken away for ease of illustration. A preconditioned rod of filter material (not shown) coming from a curing station, for example, enters the crimping assembly 10 at 35 (FIG. 2) and leaves the assembly at 13. In passing through the crimping assembly 10, the rod is intermittently contacted by the crimping wheels 14 which are arranged as two pairs of opposed wheels. The crimping wheels 14, which will be described more fully hereinafter, are driven by conventional means, such as bevel gears 15 which are interconnected by shafts 24 which, in turn, are powered by an external power source (not shown) through drive means 17. The crimping wheels 14 are mounted so that their peripheral portions extend into and are heated by a separately insulated, central heater block 18. As shown in FIG. 2, an end plate 37 is mounted at the inlet end of the assembly 10, with the heater block 18 centered and protruding through the end plate 37. A similar end plate 47 is mounted on the opposite end of the apparatus. A steam entrance housing 20 is attached to the outer face of the inlet end plate 37 by means such as bolts, the housing 20 being in fluid communication with steam insert 36 centered within the heater block 18. The heater block 18 incorporates four cartridge heaters (not shown) in longitudinal conduits 21.

Positioned around the heater block 18 is an insulation frame 19 which covers the entire longitudinal exterior surface of the heater block 18. This frame 19 may be formed of a glass filled epoxy material, for example. A temperature sensing thermocouple probe 22 is located within the block 18 in a position which allows highly accurate measurement and control of temperature in proximity to the point of use of the heat provided by the heater block 18 to heat the crimping wheels 14.

Each of the crimping wheels 14 comprises a plurality of axially projecting embossing portions and associated grooves circumferentially spaced around the periphery of the wheel 14. The particular configuration of the embossing portions is not important for the purposes of the present invention, and may correspond, for example, to the configuration as described in U.S. Pat. No. 3,826,177. Alignment slots 41 have been provided in the crimper wheels 14 to allow precision alignment of the wheels 14. As an additional improvement, the wheels 14 are preferably fabricated from heat hardenable steel and treated with an electro-deposition process which infuses pure chromium onto the surface of the metal treated, thus providing a low coefficient of friction and high wear surface giving greater wear life to the wheels 14. Such a process may be, for example, the process known as Armaloy, trademark of Armaloy Co. of North Carolina, Inc., which infuses 99% pure chromium onto the surface of the metal treated.

The separate insulated central heater block 18 incorporating the steam entrance housing 20 allows for concentration of the heat where needed, while also minimizing heat build-up in the side plate bearing blocks to achieve longer bearing life due to the absence of heat, and providing an improved location for the temperature sensing thermocouple probe 22 (FIG. 2) to provide closer control of the temperature at the point of use. The present heater block configuration also allows for precision alignment of the steam insert, as well as a means of directing condensation from the steam insert housing away from the rod being formed and directing this condensation away from other machine bed components, thus preventing them from being wetted.

Steam enters the steam entrance housing 20 from any suitable source of steam (not shown), passing through top opening 56 and through a steam nozzle 57 into a circumferential plenum chamber 58 (FIG. 2). The steam vapor passes through the eight equally spaced steam holes 59 angularly positioned in steam insert 36, while steam condensate passes out the bottom of the housing 20 through an opening 61, then through an ancillary needle control valve (not shown) to a condensate collection point removed from the apparatus 10. The needle valve is usually opened only slightly to allow escape of condensate with a very small amount of vapor, the latter only in sufficient quantity to assure that all condensate is being removed. The steam which enters the preformed fibrous rod of filter material should all condense on the fibrous rod, heating and conditioning the rod for subsequent crimping by the wheels 14. Any steam which escapes into the entrance chamber 63 of the housing 20 should condense and drain out the hole 64 at the bottom of the chamber 63.

The drive means for the crimper assembly 10 includes a jack shaft 12 connected by a universal joint 23 to drive shaft 24. (The male end of the universal joint 23 is slotted as shown in FIG. 1 at 23*a* to receive a coupling shoulder bolt 23*b* and which allows for lateral alignment of coupling crimper assembly to jack shaft 12.) The shaft 24 extends through an outboard bearing block 25 which is aligned with the housing 11 by two precision taper pins 16 prior to bolting in place. The bearing block 25 houses a bearing 26 which is retained by a bearing retainer 27, the shaft 24 engaging the bearing 26 as it rotates. The shaft 24 then extends through a bevel gear 15 and a pair of bearings 29 mounted within the housing 11 on either side of a respective crimping wheel 14 (and then through a second bevel gear 15 as seen in FIG. 1.). The shaft 24 is secured to the respective crimping wheel 14 by any suitable means. A preferred securing means which serves to align each wheel 14 with the respective shaft 24 is the use of a pair of radial alignment slots 41 spaced at 180° on the face of the wheel 14. Prior to assembling the housing 11, bolts 43 are inserted through hub slots 40 of the drive shaft and loosely threaded into wheel 14. In making the initial alignment, these radial slots 41 are aligned with holes 42 extending through the side plate bearing blocks 38, 39. An alignment-locking rod (not shown) having a diameter slightly smaller than the width of the radial slot 41 is next passed through the hole 42 on one side, through the radial slot 41 and on into the hole 42 on the other side of the wheel 14, thus locking the wheel 14 in position. After torque is applied to drive shaft 12, an Allen wrench is then inserted through the hole 44 and the bolt 43 is tightened to a snug condition. The alignment rod is then removed, the wheel 14 turned 180° and the second bolt 43 is snugged. The wheel 14 is then rotated 90° and a third bolt 43 is snugged, then the wheel 14 is rotated 180° and the fourth bolt 43 is snugged. Each bolt 43 is then returned to the hole 44 location and retightened securely, thus securing the shaft 24 to the crimping wheel 14.

A total of four shafts 24 are provided, each in conjunction with a respective outboard bearing block 25, as indicated in FIG. 1, with the result that these bearing block 25 and shaft 24 arrangements are interchangeable in any of the four positions within the crimper assembly 10. The jack shaft 12 imparts rotation to the drive shaft 24 with which it is in engagement, and through the system of bevel gears 15, all four of the crimping wheels 14 are driven in unison.

As shown in FIGS. 1 and 3, in order to provide lubrication to both main bearings 29 on each side of the crimper wheel 14, a wavey washer thrust spring 32 is provided outwardly of bearing 29, in left side plate 39, followed by a bearing retainer plate 31, which allows for adjusting the thrust load on the wavey washer spring 32. A tension lock 28 allows for a positive locking of the bearing retainer plate 31. A plan view of the retainer plate 31 is shown in FIG. 4, while FIG. 5 shows a plan view of the tension lock 28.

The tension lock 28 operates to lock the bearing retainer plate 31 by means of a tension locking pin 45 which is screwed into one of the holes 68 of the tension lock 28. The particular hole selected is that most nearly in line with one of the holes 69 of the bearing retainer plate 31, the retainer plate 31 being advanced or retarded to achieve the desired alignment.

The right side plate 38 contains a bearing 29 and outwardly is followed by a slotted bearing spacer 30 followed by a bearing retainer plate 31. The wavey washer thrust spring 32 on left side plate 39 and the bearing spacer 30 on right side plate 38 provide for fluid communication via the inlet lubrication channel, grease fitting 33 (shown only in the right side plate 38) and filling the bearing 29 ball cage with any excess relieved through the outlet lubrication channel on the left of side plate 38.

The improved separate side plate bearing block configuration 38, 39 which is insulated from the heater block 18 as previously mentioned, includes the feature that larger and different type bearings 29 can be used which will take significantly greater thrust and radial loading, thereby providing longer bearing life and, particularly, longer life of bearing retainer cages. The side plate bearing blocks 38, 39 allow for unit assembly housing 11 to be interchangeable in any of the four positions within the crimper assembly. The side plate bearing blocks 38, 39 and the one-sided shielded bearings allow for periodic lubrication of the bearings 29 as well as for the possible use of a spring-loaded lubrication housing to provide lubrication to the bearings 29 when required. Cooling chambers 65 in the side plate bearing blocks 38, 39 make possible the use of a coolant which is passed into the chambers 65 which is in fluid communication with inlet hole 66 in side plate 38 and outlet hole 62 in side plate 39, to maintain a lower temperature of the bearings 29. Also, the side plate bearing blocks 38, 39 have been designed to enclose and protect the peripheral pattern of the crimper wheels 14. In addition, the outboard bearing blocks 25 provide additional bearing support of the crimper wheel shaft 24, thereby insuring more stable alignment and truer running of the crimper wheels 14 during operation. An outboard bearing block 25 and retainer plate 27 secures the outboard bearings 26.

The incorporation of the eight bevel gears 15 to provide a positive interlock in a 360° circle can be achieved with the gears 15 being adjusted into precision mesh by lock nuts 34 and held in mesh by the use of retaining screws that engage the lock nut 34 and the gears 15. A keyway 70 on shaft 24 and within gear 15 and a corresponding key 71 prevent rotational movement of the gear after the gear 15 is locked in place to the lock nut 34.

Plane alignment of the crimping wheels 14 is provided by the use of a base plate and eccentric nut arrangement. In making this alignment, a base plate 46 is overlayed onto the end plate 37, 47, as shown in FIGS. 1 and 2, with four corner holes of base plate 46 being positioned over four corresponding holes in the end plate 37, 47. As shown in the drawings, a base plate 46 is provided on both sides of the end plates 37, 47 retaining housing 11. A bolt 48 is passed down through each of the holes and is threaded into tapped holes in the side plates 38, 39 of housing 11. These bolts 48 are snugged, but not tight.

Figure 6:
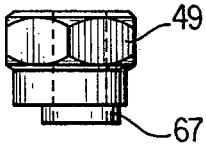
FIG. 6 is an elevation of an eccentric nut configuration employed in the present invention.

An eccentric nut 49, shown in FIG. 6, is fitted into each of the two center slots 50 of the base plate 46 and a bolt 51 is passed through the eccentric nut 49 and threaded snug into a tapped hole in the respective end plate 37, 47. The lower portion 67 of each nut 49 fits into the recess in the end plate. It is noted that each of the two slots 50 are oval-shaped, with the longitudinal axis of one slot 50 extending horizontally while that of the other slot 50 extends vertically relative to the base plate 46. The eccentric nuts 49 are then adjusted to move the housing 11 which includes the side plates 38, 39 into exact alignment so that the lobes of the wheels 14 have the desired position and clearance.

The heater block 18 may be aligned by the use of the hole 52 in the end thereof. An alignment pin (not shown) having a stepped diameter is inserted into the center hole 13 of the back end plate 47. The diameter of hole 13 is slightly larger than that of hole 52. The alignment pin is then passed into hole 52. A pin 53 is next inserted through the 180° positioned hole in the end plate 47 and into a matching hole in the heater block 18. The heater block 18 is thus locked in alignment and two additional bolts 54 are inserted into the 90° and 270° holes of the end plate 47 and securely tightened into a tapped hole of the heater block 18. The preceeding, in conjunction with the centering and protrusion of the heater block through end plate 37 assures precise alignment of the fibrous body passage way through the crimper assembly.

From the foregoing description, it is apparent that the subject crimper assembly includes many novel features which are highly advantageous for use in imparting a crimped configuration to any of various materials, including filter materials employed in the manufacture of cigarettes and the like.

It is thought that the invention and many of its attendant advantages will be understood from the foregoing description, and it will be apparent that various changes may be made in the form, construction and arrangement of the parts without departing from the spirit and scope of the invention or sacrificing all of its material advantages, the forms hereinbefore described being merely preferred embodiments thereof.

It is claimed:

1. In a crimping assembly for crimping a rod of fibrous material, said assembly having at least one pair of crimping wheels each having embossing means defined on its peripheral surface, means for rotatably supporting each pair of crimping wheels so as to juxtapose their respective embossing means and means for rotating each crimping wheel, the improvement comprising a separate insulated central heater block extending axially through said crimping assembly, said heater block having at least one axially extending cartridge heater conduit located within said heater block for heating said crimping wheels.

2. The crimping assembly of claim 1, wherein a thermocouple probe is mounted within said heater block.

3. The crimping assembly of claim 1, further including a side plate bearing block on each side of said crimping wheels, said bearing blocks being insulated from the heater block, each of said bearing blocks having mounted therein a bearing which supports said means for rotating the crimping wheels, means for periodically lubricating the bearings, and with each of said bearing blocks being interchangeable with the remaining bearing blocks within said crimping assembly.

4. The crimping assembly of claim 3, wherein a wavey washer thrust spring and slotted bearing spacer are provided to allow feeding of lubricant to the respective bearing, and with an outlet lubrication channel for excess lubricant.

5. The crimping assembly of claim 3, wherein at least one cooling chamber is provided in each of said side plate bearing blocks for the cooling of the bearings located therein.

6. The crimping assembly of claim 1, wherein an alignment hole is provided in one end of said heater block, and wherein an end plate is provided for said assembly adjacent said one end of said heater block, the hole in said heater block being alignable with a corresponding hole in the end plate, and including means for securing said heater block in alignment with said end plate.

7. The crimping assembly of claim 1, wherein a steam insert having a plurality of axially spaced steam holes is provided in alignment with the path of the rod of fibrous material through said assembly.

8. The crimping assembly of claim 7, wherein a plenum chamber is located circumferentially around said steam insert.

9. In a crimping assembly for crimping a rod of fibrous material, said assembly having at least one pair of crimping wheels each having embossing means defined on its peripheral surface, means for rotatably supporting each pair of crimping wheels so as to juxtapose their respective embossing means and means for rotating each crimping wheel, the improvement comprising a steam entrance housing attached to an outer face of said assembly in axial alignment with the crimping area formed by said crimping wheels, a passageway in said housing through which the fibrous rod passes for preconditioning prior to being crimped, said housing including means for passing steam through said housing and separate passageway means for venting condensed steam away from the fibrous rod.

10. In a crimping assembly for crimping a rod of fibrous material, said assembly having at least one pair of crimping wheels each having embossing means defined on its peripheral surface, means for rotatably supporting each pair of crimping wheels so as to juxtapose their respective embossing means and means for rotating each crimping wheel, the improvement comprising a side plate bearing block on each side of said crimping wheels, each of said bearing blocks having mounted therein a bearing which supports said means for rotating the crimping wheels, means for periodically lubricating the bearings including spring means located outwardly of the bearing in one side plate, followed by a bearing retainer plate and means for locking said retainer plate, and including a bearing spacer located outwardly of the bearing in the other side plate, followed by a bearing retainer plate, and with each of said bearing blocks being interchangeable with the remaining bearing blocks within said crimping assembly.

11. In a crimping assembly for crimping a rod of fibrous material, said assembly having at least one pair of crimping wheels each having embossing means defined on its peripheral surface, means including a side plate bearing block and bearing on each side of each crimping wheel for rotatably supporting each pair of crimping wheels so as to juxtapose their respective embossing means and means for rotating each crimping wheel, the improvement comprising an outboard bearing block disposed outwardly from each side plate bearing block and having mounted therein a shaft which comprises the means for rotatably supporting the respective crimping wheel, each outboard bearing block having mounted therein a bearing which engages the shaft as the shaft rotates.

* * * * *